US011189162B2

(12) United States Patent
Kusama et al.

(10) Patent No.: US 11,189,162 B2
(45) Date of Patent: Nov. 30, 2021

(54) INFORMATION PROCESSING SYSTEM, PROGRAM, AND INFORMATION PROCESSING METHOD

(71) Applicant: TOYOTA JIDOSHA KABUSHIKI KAISHA, Toyota (JP)

(72) Inventors: Eiichi Kusama, Anjo (JP); Masatoshi Hayashi, Nisshin (JP); Hisanori Mitsumoto, Hadano (JP); Kuniaki Jinnai, Nagoya (JP); Makoto Akahane, Tokyo (JP); Yuriko Yamaguchi, Tokyo (JP); Daisuke Kato, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 77 days.

(21) Appl. No.: 16/710,369

(22) Filed: Dec. 11, 2019

(65) Prior Publication Data

US 2020/0193810 A1 Jun. 18, 2020

(30) Foreign Application Priority Data

Dec. 14, 2018 (JP) ..... JP2018-234146

(51) Int. Cl.
*G08G 1/04* (2006.01)
*G08G 1/01* (2006.01)
*G08G 1/052* (2006.01)

(52) U.S. Cl.
CPC ..... *G08G 1/0133* (2013.01); *G08G 1/0137* (2013.01); *G08G 1/04* (2013.01); *G08G 1/052* (2013.01)

(58) Field of Classification Search
CPC ..... G08G 1/0133; G08G 1/052; G08G 1/04; G08G 1/0137; G08G 1/0141; G08G 1/096775; G08G 1/0112; G08G 1/0968; G08G 1/0104; B60R 1/00; B60R 16/02; H04N 7/18; H04B 1/3822; H04W 4/40
See application file for complete search history.

(56) References Cited

U.S. PATENT DOCUMENTS

2002/0128770 A1* 9/2002 Ooishi ..... G01C 21/26 701/516
2010/0114465 A1* 5/2010 Kim ..... H04H 20/55 701/117
2012/0033123 A1* 2/2012 Inoue ..... G08G 1/04 348/333.13
2012/0209510 A1* 8/2012 Ikawa ..... G01C 21/3492 701/423
2012/0271544 A1* 10/2012 Hein ..... G01C 21/3407 701/423

(Continued)

FOREIGN PATENT DOCUMENTS

JP 2014-228434 A 12/2014

*Primary Examiner* — Ojiako K Nwugo
(74) *Attorney, Agent, or Firm* — Sughrue Mion, PLLC

(57) ABSTRACT

An information processing system includes a vehicle and a server that is communicable with the vehicle. The vehicle acquires a moving image obtained by imaging an oncoming lane during traveling. At least one of a congestion section and a congestion degree of the oncoming lane is determined based on the moving image. The server stores at least one of the congestion section and the congestion degree of the oncoming lane and provides information to a client by using the stored information.

6 Claims, 7 Drawing Sheets

(56) References Cited

U.S. PATENT DOCUMENTS

| | | | | |
|---|---|---|---|---|
| 2013/0124073 | A1* | 5/2013 | Ren | G08G 1/0112 701/118 |
| 2016/0069703 | A1* | 3/2016 | Nakano | G09B 29/007 701/428 |
| 2016/0217333 | A1* | 7/2016 | Ozawa | G08G 1/164 |
| 2018/0181139 | A1* | 6/2018 | Ishii | G08G 1/166 |
| 2018/0196443 | A1* | 7/2018 | Bai | H04W 4/023 |
| 2018/0326996 | A1* | 11/2018 | Fujisawa | B60W 50/085 |
| 2019/0049253 | A1* | 2/2019 | Kitamura | G08G 1/0133 |
| 2019/0186929 | A1* | 6/2019 | Iwata | G01C 21/34 |
| 2019/0186945 | A1* | 6/2019 | Choi | G05D 1/0088 |
| 2019/0189004 | A1* | 6/2019 | Suzuki | G08G 1/0141 |
| 2019/0219413 | A1* | 7/2019 | Prakah-Asante | G01C 21/3697 |
| 2020/0019173 | A1* | 1/2020 | Chen | G05D 1/0088 |
| 2020/0058219 | A1* | 2/2020 | Hassani | G08G 1/04 |
| 2020/0124423 | A1* | 4/2020 | Jiang | G05D 1/0088 |
| 2020/0124435 | A1* | 4/2020 | Edwards | G08G 1/0969 |
| 2020/0406753 | A1* | 12/2020 | Hayashi | G09G 5/38 |

* cited by examiner

INFORMATION PROCESSING SYSTEM, PROGRAM, AND INFORMATION PROCESSING METHOD

INCORPORATION BY REFERENCE

The disclosure of Japanese Patent Application No. 2018-234146 filed on Dec. 14, 2018 including the specification, drawings and abstract is incorporated herein by reference in its entirety.

BACKGROUND

1. Technical Field

The disclosure relates to an information processing system, a program, and an information processing method.

2. Description of Related Art

In the related art, a technology for providing information on road congestion has been known. For example, Japanese Unexamined Patent Application Publication No. 2014-228434 (JP 2014-228434 A) discloses a navigation device that acquires a changing point of a traffic volume of a road, acquires a traveling vehicle image obtained by imaging the load at the changing point, and displays the traveling vehicle image in a display mode in which a position of the changing point is identified.

SUMMARY

In the disclosure disclosed in JP 2014-228434 A, each of a head position and a tail position of a congestion section indicated in congestion information from a VICS (registered trademark, which stands for "vehicle information and communication system") center is acquired as the changing point of the traffic volume on the road. However, the congestion information provided from the VICS center indicates a rough congestion section and congestion degree, and the accuracy thereof is not always sufficient. Therefore, there is room for improvement in the technology for providing information on road congestion.

An object of the disclosure made in consideration of the above circumstances is to provide a technology for providing information on congestion on a road.

A first aspect of the disclosure relates to a system including a vehicle and a server configured to communicate with the vehicle. The vehicle acquires a moving image obtained by imaging an oncoming lane during traveling. The vehicle or the server determines at least one of a congestion section and a congestion degree of the oncoming lane based on the moving image. The server is configured to store at least one of the congestion section and the congestion degree of the oncoming lane, and provide information to a client by using the stored information.

A second aspect of the disclosure relates to a program. The program causes a vehicle that is communicable with a server to execute steps of acquiring a moving image obtained by imaging an oncoming lane during traveling, determining at least one of a congestion section and a congestion degree of the oncoming lane based on the moving image, and transmitting, to the server, the at least one of the congestion section and the congestion degree of the oncoming lane.

A third aspect of the disclosure relates to an information processing method executed by a system including a vehicle and a server that is communicable with the vehicle. The method includes acquiring, by the vehicle, a moving image obtained by imaging an oncoming lane during traveling, determining, by the vehicle or the server, at least one of a congestion section and a congestion degree of the oncoming lane based on the moving image, storing, by the server, at least one of the congestion section and the congestion degree of the oncoming lane, and providing, by the server, information to a client by using the stored information.

With the information processing system, the program, and the information processing method according to the aspects of the disclosure, the technology for providing information on road congestion is improved.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, an embodiment of the disclosure will be described.

Configuration of Information Processing System

Figure 1:
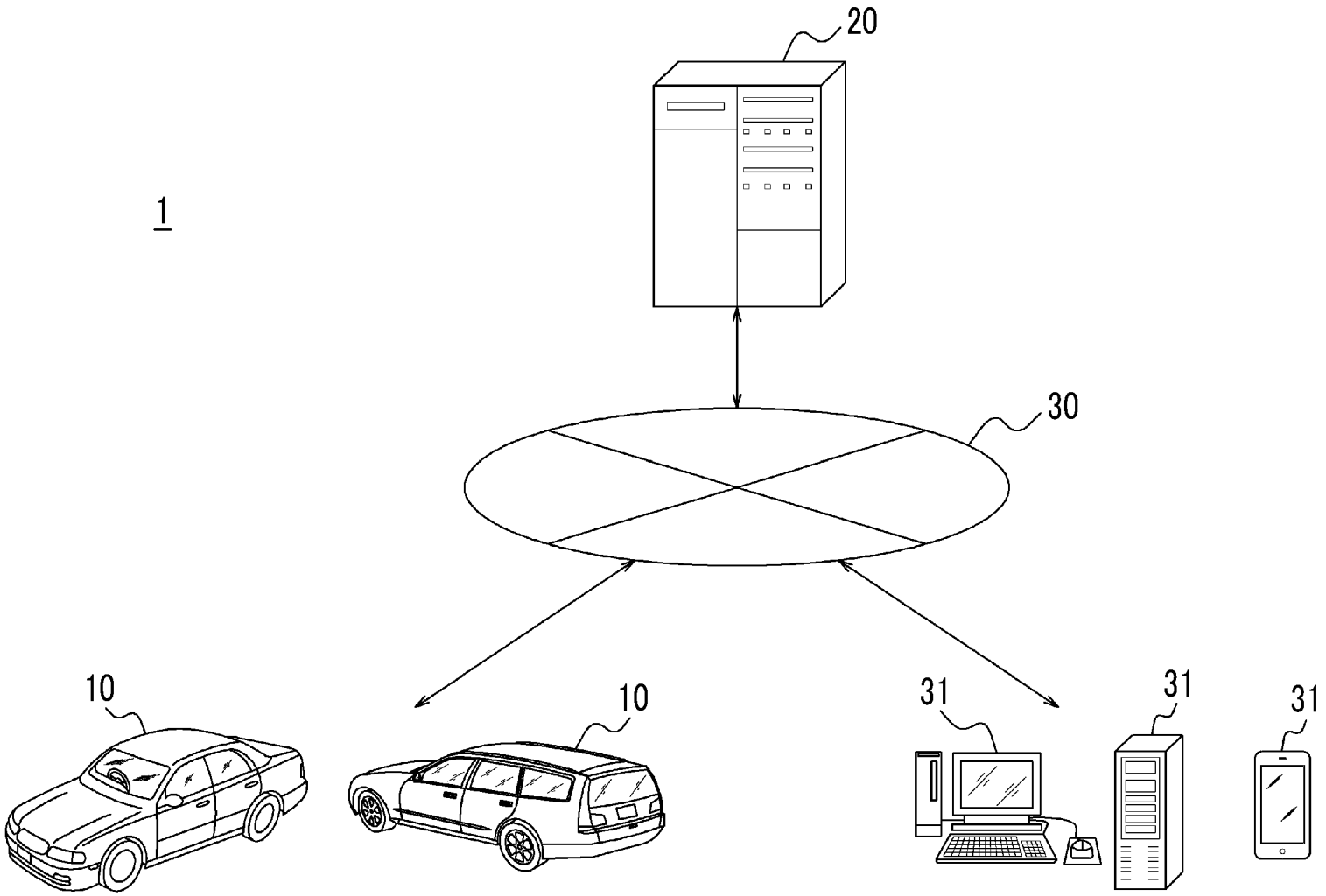
FIG. 1 is a diagram showing a schematic configuration of an information processing system according to an embodiment of the disclosure.

An outline of an information processing system 1 according to an embodiment of the disclosure will be described with reference to FIG. 1. The information processing system 1 includes one or more vehicles 10 and a server 20. The vehicle 10 is, for example, an automobile, but is not limited thereto, and may be any vehicle. Solely two vehicles 10 are exemplified in FIG. 1 for convenience of the description, but the information processing system 1 may include any number of vehicles 10. The server 20 includes one or a plurality of information processing devices (for example, server devices) configured to communicate with each other. The vehicle 10 and the server 20 can communicate with each other through a network 30 including, for example, a mobile communication network and the Internet. In addition, the server 20 can communicate with a client 31 through the network 30. The client 31 is, for example, a personal computer (PC), a smartphone, or a server device, but may be a predetermined information processing device.

The outline of the embodiment will be first described, and the details thereof will be described below. The vehicle 10 includes, for example, an in-vehicle camera, acquires a moving image obtained by imaging an oncoming lane during traveling. The vehicle 10 determines a congestion section and/or a congestion degree of the oncoming lane based on the moving image, and transmits the determination result and the like, to the server 20. The server 20 collects information from one or more vehicles 10 to store a congestion section and/or a congestion degree for each lane. Then, the server 20 provides information to the client 31 by using the stored information.

As described above, according to the embodiment, the congestion section and/or the congestion degree of the oncoming lane is determined by using the moving image that the vehicle 10 has actually imaged during traveling. The congestion section and/or the congestion degree of the oncoming lane determined by using the actual moving image is highly accurate information that more closely matches the actual situation in the field, for example, compared to the rough congestion section and the congestion degree indicated in the road traffic information provided from the VICS. Therefore, since the accuracy of the information provided to the client 31 is improved, the technology for providing information regarding congestion on the road is improved.

Next, each configuration of the information processing system 1 will be described in detail.

Configuration of Vehicle

Figure 2:
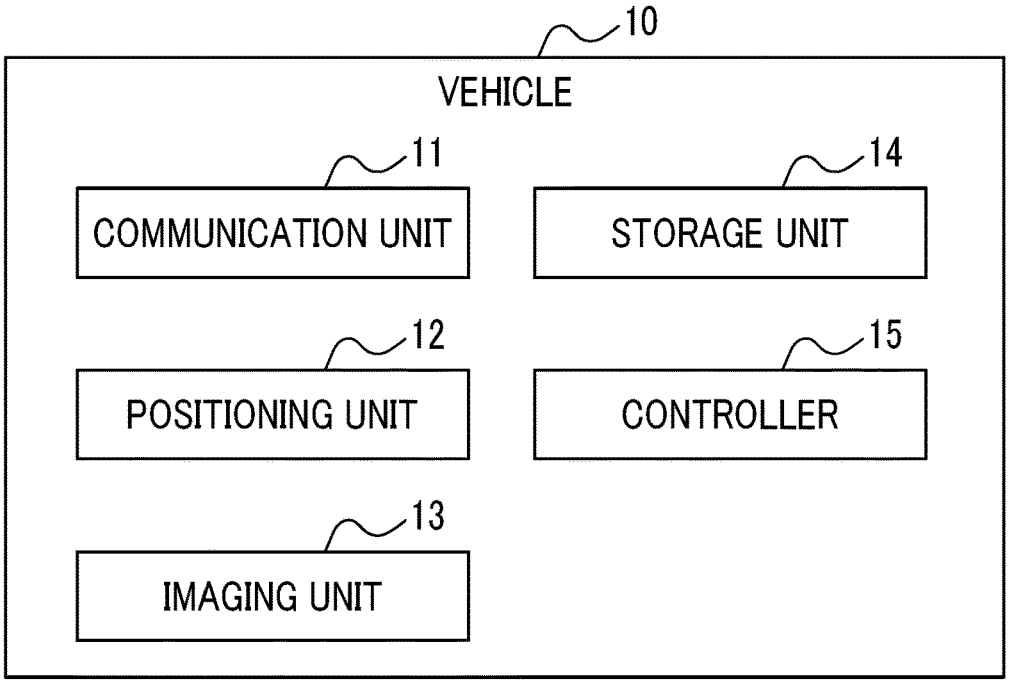
FIG. 2 is a block diagram showing a schematic configuration of a vehicle.

As shown in FIG. 2, the vehicle 10 includes a communication unit 11, a positioning unit 12, an imaging unit 13, a storage unit 14, and a controller 15. The communication unit 11, the positioning unit 12, the imaging unit 13, the storage unit 14, and the controller 15 may be respectively built in the vehicle 10 or may be respectively provided in the vehicle 10 in a detachable manner. The communication unit 11, the positioning unit 12, the imaging unit 13, the storage unit 14, and the controller 15 are connected to each other in a communicable manner through, for example, an on-vehicle network such as controller area network (CAN) or a dedicated line. The communication unit 11, the positioning unit 12, the imaging unit 13, the storage unit 14, and the controller 15 may be each provided as a single device or a plurality of devices.

The communication unit 11 includes a communication module connected to the network 30. The communication module is compatible with mobile communication standards such as 4th Generation (4G) and 5th Generation (5G), but is not limited thereto, and may be compatible with any communication standard. For example, an on-vehicle communication apparatus such as data communication module (DCM) may function as the communication unit 11. In the embodiment, the vehicle 10 is connected to the network 30 through the communication unit 11.

The positioning unit 12 includes a receiver compatible with a satellite positioning system. The receiver is compatible with, for example, a global positioning system (GPS), but is not limited thereto, and may be compatible with any satellite positioning system. The positioning unit 12 includes, for example, a gyro sensor and a geomagnetic sensor. For example, a car navigation device may function as the positioning unit 12. In the embodiment, the vehicle 10 acquires the position of a host vehicle and a direction in which the host vehicle is facing by using the positioning unit 12.

The imaging unit 13 includes an in-vehicle camera that images a subject in the field of view and generates a moving image. The moving image includes a plurality of still images captured at a predetermined frame rate (for example, 30 fps). Hereinafter, each of the still images is also referred to as a frame. The in-vehicle camera may be a monocular camera or a stereo camera. The imaging unit 13 is included in the vehicle 10 such that the oncoming lane can be imaged during traveling. For example, an electronic apparatus having a camera function such as a drive recorder or a smartphone used by an occupant may function as the imaging unit 13. In the embodiment, the vehicle 10 uses the imaging unit 13 to acquire a moving image obtained by imaging the oncoming lane during traveling.

The storage unit 14 includes one or more memories. In the embodiment, the "memory" is, for example, a semiconductor memory, a magnetic memory, or an optical memory, but is not limited thereto. Each memory included in the storage unit 14 may function as, for example, a main storage device, an auxiliary storage device, or a cache memory. The storage unit 14 stores predetermined information used for the operation of the vehicle 10. For example, the storage unit 14 may store a system program, an application program, embedded software, road map information and the like. The road map information includes, for example, road link identification information, node identification information, and lane identification information. The information stored in the storage unit 14 may be updatable with, for example, information to be acquired from the network 30 through the communication unit 11.

The controller 15 includes one or more processors. In the embodiment, the "processor" is a general-purpose processor, a dedicated processor specialized for specific processing, or the like, but is not limited thereto. For example, an electronic control unit (ECU) mounted on the vehicle 10 may function as the controller 15. The controller 15 has a time measuring function for grasping the current time. The controller 15 controls the operation of the entire vehicle 10.

Figure 3:
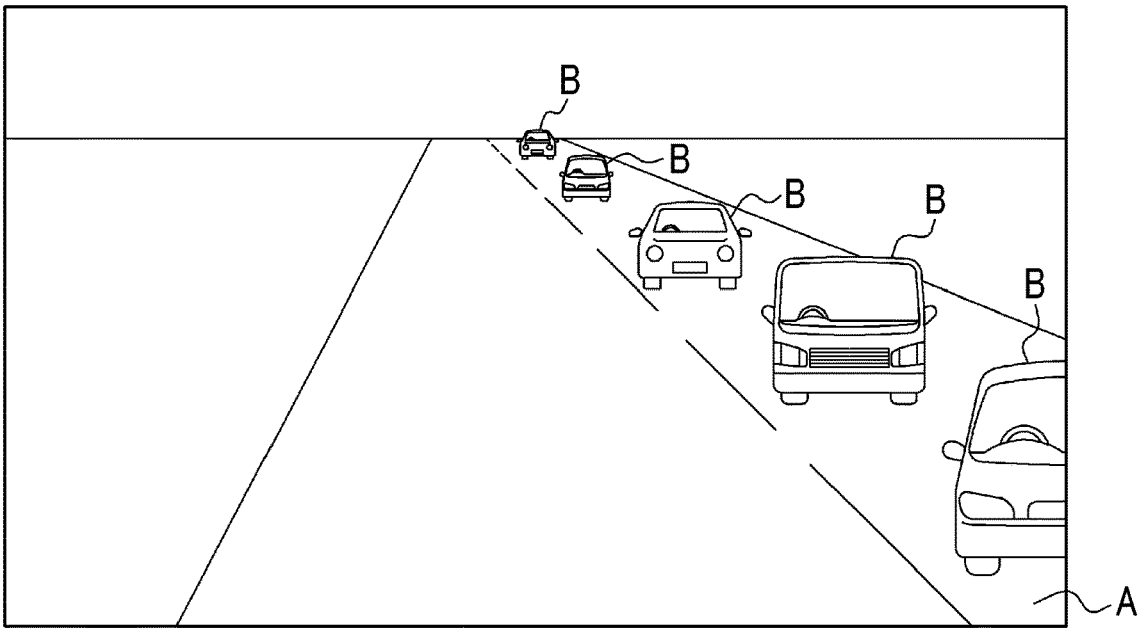
FIG. 3 is a diagram showing an example of a frame of a moving image obtained by imaging an oncoming lane.

For example, the controller 15 uses the imaging unit 13 to acquire a moving image obtained by imaging the oncoming lane during traveling. In each frame of the moving image, for example, an oncoming vehicle B on the oncoming lane A can appear as shown in FIG. 3. FIG. 3 shows an example of a moving image of a front camera that images areas in front of the vehicle 10, for example, but a moving image of a side camera that images areas on the side of the vehicle 10 may be used. Although FIG. 3 shows an example of one road consisting of a double lane, a road including three or more lanes may be used. Further, the lane in which the vehicle 10 travels and the oncoming lane may be separated by, for example, a median strip. The controller 15 uses the positioning unit 12 to acquire the position (imaging position) of the host vehicle when the moving image is captured. The controller 15 acquires the time (imaging time) when the moving image is captured. The imaging time may include the year, month, and date in addition to the hour and minute.

In addition, the controller 15 determines at least one of a congestion section and a congestion degree of the oncoming lane based on the acquired moving image. Hereinafter, a method of determining a congestion section and a congestion degree will be specifically described.

In general, a vehicle being in congestion has a characteristic of a relatively slow vehicle speed and a relatively short inter-vehicle distance to a following vehicle. Therefore, it can be detected whether an individual vehicle is in congestion based on the vehicle speed and the inter-vehicle distance to the following vehicle. The controller 15 detects, from the moving image, a plurality of oncoming vehicles on the oncoming lane which has a vehicle speed less than a reference speed and an inter-vehicle distance to the following vehicle less than a reference distance, as oncoming vehicles in congestion (congested oncoming vehicles). The reference speed and the reference distance may be determined in advance based on, for example, the results of experiments or simulations, or dynamically determined according to the type of road (for example, a general road or a highway), a speed limit, or the like.

It should be noted that any method using a moving image can be employed for detecting the vehicle speed and the inter-vehicle distance of the oncoming vehicle. For example, the controller 15 detects a stationary object, an oncoming vehicle and a vehicle following the oncoming vehicle on the moving image by image recognition. The stationary object is, for example, a streetlight, a roadside tree, a guardrail, a sign, or a signal light installed near the road, but is not limited thereto. Any image recognition algorithm, such as pattern matching, feature point extraction, or machine learning, can be employed for the detection of the stationary object and the oncoming vehicle. The controller 15 sets the position of the host vehicle as the origin and detects, from the moving image, position coordinates of the stationary object, position coordinates of the oncoming vehicle, and position coordinates of the following vehicle by, for example, three-dimensional restoration. The three-dimensional restoration can be performed, for example, using multi-viewpoint images obtained by a motion stereo method using a moving image from a monocular camera or a stereo method using a moving image from a stereo camera. The controller 15 detects the vehicle speed of the oncoming vehicle based on a temporal change in the difference between the position coordinates of the stationary object and the position coordinates of the oncoming vehicle. The controller 15 detects the inter-vehicle distance of the oncoming vehicle based on the difference between the position coordinates of the oncoming vehicle and the position coordinates of the following vehicle.

The controller 15 determines the congestion section of the oncoming lane based on, among a plurality of frames included in the moving image, an imaging position (first imaging position) of a frame of when the host vehicle passes by the first congested oncoming vehicle and an imaging position (second imaging position) of a frame of when the host vehicle passes by the last congested oncoming vehicle. Specifically, the controller 15 determines the congestion section by regarding the first imaging position and the second imaging position as the head position and the tail position of the congestion section, respectively.

The controller 15 determines the congestion degree of the oncoming lane based on the vehicle speed of the congested oncoming vehicle. Specifically, the controller 15 determines that the congestion degree of the oncoming lane is higher as a vehicle speed of one of the congested oncoming vehicles or an average vehicle speed of two or more of the congested oncoming vehicles is slower. In addition, the congestion degree may be indicated by a grade (for example, "low", "medium", and "high") or may be indicated by a numerical value.

In addition, the controller 15 refers to the road map information stored in the storage unit 14 and specifies lane identification information of the oncoming lane. The controller 15 transmits, to the server 20 through the communication unit 11, at least one of the lane identification information of the oncoming lane, a time slot to which the imaging time of the moving image belongs (for example, 12: 10 to 12: 20), and the congestion section and the congestion degree of the oncoming lane. The controller 15 may further transmit, to the server 20, above-mentioned frames, that is, the frame (head image) of when the host vehicle pass by the first oncoming vehicle and the frame (tail image) of when the vehicle passes by the last oncoming vehicle.

Configuration of Server

Figure 4:
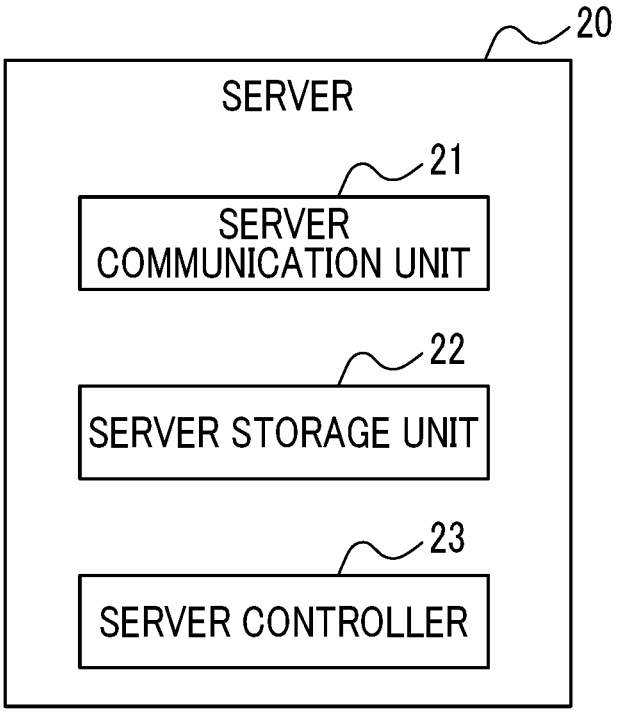
FIG. 4 is a block diagram showing a schematic configuration of a server.

As shown in FIG. 4, the server 20 includes a server communication unit 21, a server storage unit 22, and a server controller 23.

The server communication unit 21 includes a communication module connected to the network 30. The communication module is compatible with, for example, a wired local area network (LAN) standard, but is not limited thereto, and may be compatible with any communication standard. In the embodiment, the server 20 is connected to the network 30 through the server communication unit 21.

The server storage unit 22 includes one or more memories. Each memory included in the server storage unit 22 may function as, for example, a main storage device, an auxiliary storage device, or a cache memory. The server storage unit 22 stores predetermined information used for the operation of the server 20. For example, the server storage unit 22 may store a system program, an application program, a database, road map information and the like. The information stored in the server storage unit 22 may be updatable with, for example, information to be acquired from the network 30 through the server communication unit 21.

The server controller 23 includes one or more processors. The server controller 23 has a time measuring function for grasping the current time. The server controller 23 controls the operation of the entire server 20.

Figure 5:
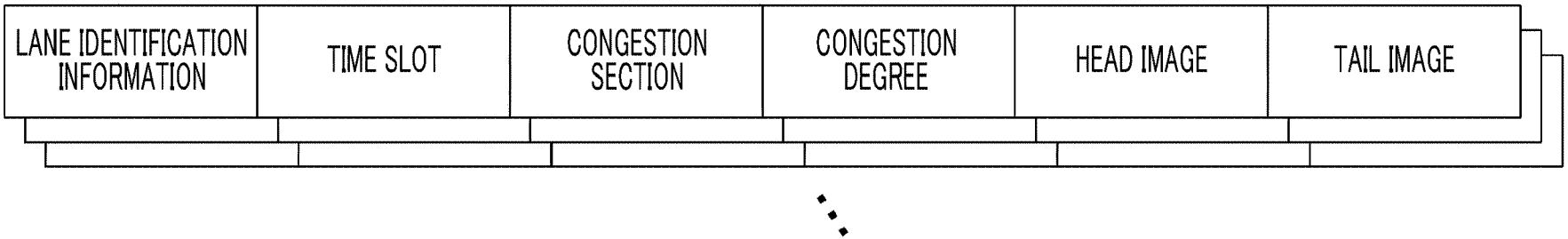
FIG. 5 is a diagram showing an example of information stored in the server.

For example, the server controller 23 receives, from the vehicle 10 through the server communication unit 21, at least one of the lane identification information of the oncoming lane, a time slot to which the imaging time of the moving image belongs, and the congestion section and the congestion degree of the oncoming lane. The server controller 23 may further receive, from the vehicle 10, the head image and tail image described above. The server controller 23 stores the received information in the server storage unit 22. Here, the server controller 23 may collect information from a plurality of vehicles 10 and store (accumulate) the collected information in the server storage unit 22. For example, as shown in FIG. 5, a combination of the lane identification information, the time slot, the congestion section, the congestion degree, the head image, and the tail image is accumulated in the server storage unit 22.

Then, the server controller 23 provides information to the client 31 by using the information stored in the server storage unit 22. The provision of information may be performed, for example, in response to the request from the client 31 (for example, pull distribution), or may be automatically performed by the server controller 23 (for example, push distribution). The provision of information may be performed by a web application stored in the server storage unit 22. The provision of information may include providing the information stored in the server storage unit 22 as it is or after processing, or may include providing any information newly generated by using the information stored in the server storage unit 22.

Figure 6:
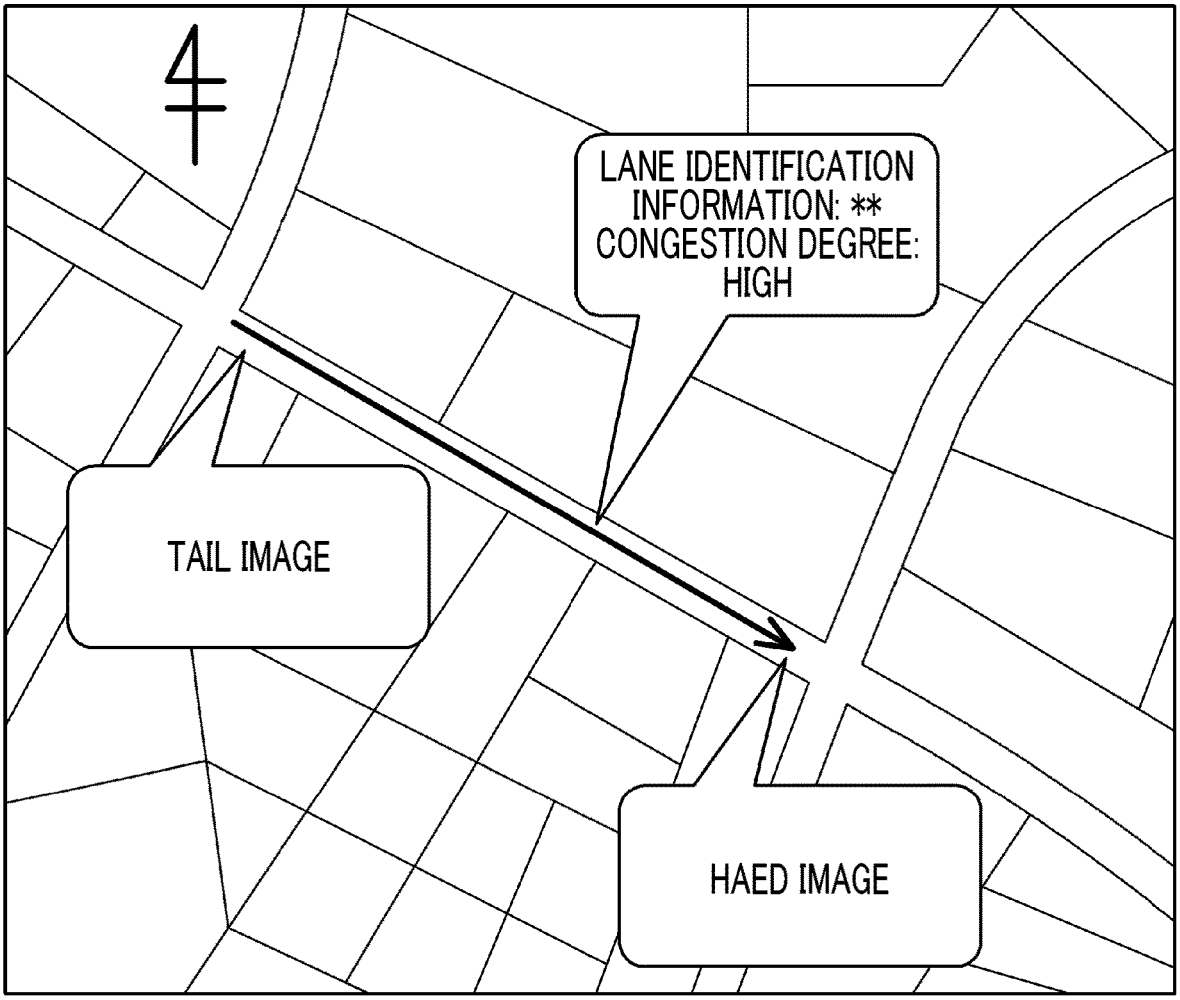
FIG. 6 is a diagram showing an example of providing information to a client from the server.

For example, FIG. 6 is a diagram showing an example of a screen displayed to the client 31 based on the information provided from the server 20. On the screen shown in FIG. 6, a congestion section indicated by an arrow, lane identification information and a congestion degree, and the head image and the tail image are displayed on the map. The user of the client 31 can grasp the congestion section and the congestion degree of the lane at a glance by visually recognizing the screen shown in FIG. 6. In addition, for example, in a state in which just the congestion section indicated by the arrow is displayed on the screen, the lane identification, the congestion degree, the head image, the tail image, and the like may be displayed according to the user operation for selecting the congestion section.

Operation Flow of Vehicle

Figure 7:
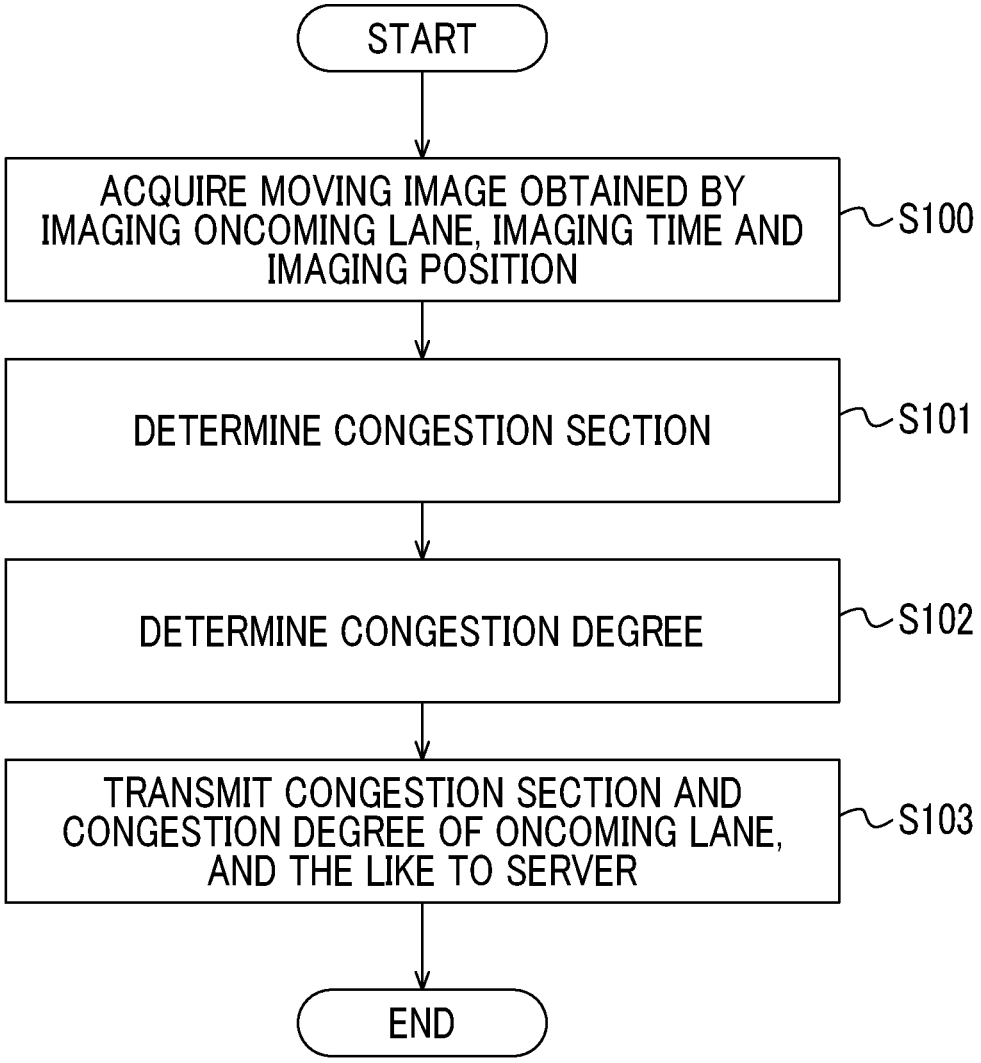
FIG. 7 is a flowchart showing an operation of the vehicle.

An operation flow of the vehicle 10 will be described with reference to FIG. 7.

Step S100: the controller 15 acquires a moving image obtained by imaging the oncoming lane during traveling, and the imaging time and imaging position of the moving image.

Step S101: the controller 15 determines the congestion section of the oncoming lane based on the moving image.

Step S102: the controller 15 determines the congestion degree of the oncoming lane based on the moving image.

Step S103: the controller 15 transmits, to the server 20 through the communication unit 11, the lane identification information of the oncoming lane, a time slot to which the imaging time of the moving image belongs, and the congestion section and the congestion degree of the oncoming lane. Here, the controller 15 may further transmit, to the server 20, above-mentioned frames, that is, the frame (head image) of when the host vehicle passes by the first oncoming vehicle and the frame (tail image) of when the vehicle passes by the last oncoming vehicle.

Operation Flow of Server

Figure 8:
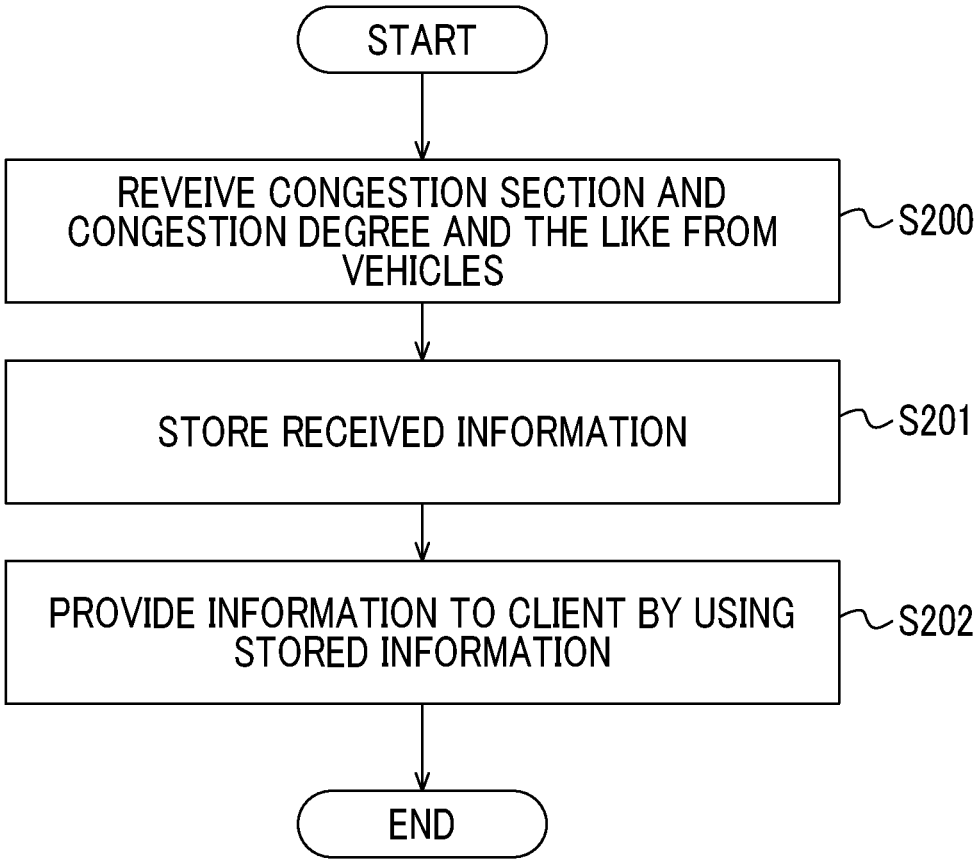
FIG. 8 is a flowchart showing an operation of the server.

An operation flow of the server 20 will be described with reference to FIG. 8.

Step S200: the server controller 23 receives, from the vehicles 10 through the server communication unit 21, at least one of the lane identification information of the oncoming lane, a time slot to which the imaging time of the moving image belongs, and the congestion section and the congestion degree of the oncoming lane. The server controller 23 may further receive, from the vehicle 10, the head image and tail image described above.

Step S201: the server controller 23 stores the information received from the vehicles 10 in the server storage unit 22. Here, the server controller 23 may collect information from the vehicles 10 and store (accumulate) the collected information in the server storage unit 22.

Step S202: the server controller 23 provides information to the client 31 by using the information stored in the server storage unit 22.

As described above, in the information processing system 1 according to the embodiment, the vehicle 10 acquires a moving image obtained by imaging an oncoming lane during traveling and determines at least one of a congestion section and a congestion degree of the oncoming lane based on the moving image. The server 20 stores at least one of the congestion section and the congestion degree of the oncoming lane and provides information to the client 31 by using the stored information. The congestion section and/or the congestion degree of the oncoming lane, which is determined by using the moving image actually imaged by the vehicle 10 during traveling, is highly accurate information that more closely matches the actual situation in the field, for example, compared to the rough congestion section and the congestion degree indicated in the road traffic information provided from the VICS. Therefore, since the accuracy of the information provided to the client 31 is improved, the technology for providing information regarding congestion on the road is improved.

The disclosure has been described based on the drawings and the examples, but it is to be noted that those skilled in the art easily perform various modifications and changes based on this disclosure. Therefore, it is to be noted that these modifications and changes are included in the scope of the disclosure. For example, the functions and the like included in each unit, each step, or the like can be disposed again so as not to be logically contradictory, and a plurality of units, steps, or the like can be combined into one, or divided.

For example, in the embodiment described above, some processing operations executed in the vehicle 10 may be executed in the server 20, and some processing operations executed in the server 20 may be executed in the vehicle 10. For example, the processing for determining a congestion section and a congestion degree may be executed by the server 20 instead of the vehicle 10.

Further, in the embodiment described above, the vehicle 10 may receive road traffic information indicating the estimated congestion section of the oncoming lane, for example, from the VICS center or the like via the network 30, and start imaging the oncoming lane when the estimated congestion section is reached. According to such a configuration, the vehicle 10 does not need to always image the oncoming lane all the time, and as a result, the processing burden on the vehicle 10 is reduced.

A general-purpose information processing devices such as a smartphone, a computer, or the like can be configured to function as a configuration unit provided in the vehicle 10 according to the embodiment described above or the server 20. Specifically, a program, in which processing contents for realizing each function of the vehicle 10, the server 20 or the like according to the embodiment are described, is stored in a memory of the information processing device such that a processor of the information processing device reads and executes the program. Therefore, the disclosure according to the embodiment can also be realized as the program that can be executed by the processor.

What is claimed is:

1. An information processing system comprising:

a vehicle; and a server configured to communicate with the vehicle, wherein:

the vehicle acquires a moving image obtained by imaging an oncoming lane during traveling, the vehicle or the server determines at least one of a congestion section and a congestion degree of the oncoming lane based on the moving image; and the server is configured to store at least one of the congestion section and the congestion degree of the oncoming lane; and provide information to a client by using the stored information.

2. The information processing system of claim 1, wherein the vehicle:

receives road traffic information indicating an estimated congestion section of the oncoming lane; and starts imaging the oncoming lane when the estimated congestion section is reached.

3. The information processing system of claim 1, wherein the vehicle or the server:

detects, from the moving image, a plurality of oncoming vehicles on the oncoming lane, which has a vehicle speed less than a reference speed and an inter-vehicle distance to a following vehicle less than a reference distance; and determines the congestion section based on an imaging position of a frame of when the vehicle passes by a first one of the oncoming vehicles and an imaging position of a frame of when the vehicle passes by a last one of the oncoming vehicles, among a plurality of frames included in the moving image.

4. The information processing system of claim 1, wherein the vehicle or the server:

detects, from the moving image, a plurality of oncoming vehicles on the oncoming lane, which has a vehicle speed less than a reference speed and an inter-vehicle distance to a following vehicle less than a reference distance; and determines that the congestion degree of the oncoming lane is higher as a vehicle speed of one of the oncoming vehicles or an average vehicle speed of two or more of the oncoming vehicles is slower.

5. A non-transitory storage medium storing instructions that are executable by one or more processors of a vehicle that is communicable with a server, the instructions causing the one or more processors to perform functions comprising:

acquiring a moving image obtained by imaging an oncoming lane during traveling;

determining at least one of a congestion section and a congestion degree of the oncoming lane based on the moving image; and transmitting, to the server, the at least one of the congestion section and the congestion degree of the oncoming lane.

6. An information processing method executed by a system including a vehicle and a server that is communicable with the vehicle, the method comprising:

acquiring, by the vehicle, a moving image obtained by imaging an oncoming lane during traveling;

determining, by the vehicle or the server, at least one of a congestion section and a congestion degree of the oncoming lane based on the moving image;

storing, by the server, at least one of the congestion section and the congestion degree of the oncoming lane; and providing, by the server, information to a client by using the stored information.

* * * * *